United States Patent [19]

Tawara

[11] 4,343,554

[45] Aug. 10, 1982

[54] KNEADER FOR PARTICULATE TO GRANULAR MATERIALS

[75] Inventor: Koji Tawara, Mishima, Japan

[73] Assignee: Taiyo Chuki Co., Ltd., Osaka, Japan

[21] Appl. No.: 137,756

[22] Filed: Apr. 7, 1980

[30] Foreign Application Priority Data

Sep. 1, 1979 [JP] Japan ..... 54-120805[U]

[51] Int. Cl.[3] ..... B28G 5/08

[52] U.S. Cl. ..... 366/65; 366/67

[58] Field of Search ..... 366/65, 66, 67

[56] References Cited

U.S. PATENT DOCUMENTS

| | | | |
|---|---|---|---|
| 1,508,031 | 9/1924 | Simpson | 366/65 |
| 2,377,307 | 6/1945 | Brown | 366/65 X |
| 3,248,761 | 5/1966 | McIlrone | 366/67 |
| 3,529,981 | 9/1970 | Hawkins | 366/65 |

*Primary Examiner*—Edward J. McCarthy

*Attorney, Agent, or Firm*—Wenderoth, Lind & Ponack

[57] ABSTRACT

An apparatus for kneading particulate to granular materials comprising a container in the form of a bottomed hollow cylinder, a vertical shaft disposed in the center of interior of the container and rotatable by a motor assembly, pivotal arms mounted on the vertical shaft and turnable only upward and downward, agitating rolls rotatably supported by the pivotal arms each at one end of the arm and each having a recessed outer peripheral pressing surface, and pressure adjusting assemblies each provided between the vertical shaft and the other end of each of the pivotal arms, the pressure adjusting assembly comprising a cylinder member, a rod and means housed in the cylinder member for biasing the rod in directions opposite to each other.

6 Claims, 7 Drawing Figures

KNEADER FOR PARTICULATE TO GRANULAR MATERIALS

BACKGROUND OF THE INVENTION

The present invention relates to a kneader for kneading particulate or granular materials with optimum efficiency in accordance with the amount of the material.

An apparatus is known for kneading molding sand with agitating rolls which are shiftable in accordance with the quantity of the molding sand to vary the pressure on the sand and ensure an efficient kneading operation.

With reference to FIG. 5 showing the apparatus, agitating rolls 2' having a flat peripheral surface are supported on a pair of arms 23', the midportions of which are pivoted on a vertical shaft 22' to render the arms turnable upward or downward. A compression spring 33' is connected between the upper ends of the arms 23'. The vertical shaft 22' is coupled to an unillustrated motor.

When the motor is driven, the agitating rolls 2' revolve around the vertical shaft 22' and, at the same time, rotate on their own axes while being supported by the arms 23', whereby molding sand can be kneaded.

With an increase in the quantity of the molding sand, the agitating rolls 2' are forced upward, whereas the compression spring 33' restrains the rise of rolls 2' to prevent the reduction of the kneading efficiency.

However when kneading an increased amount of molding sand, the peripheral surface of each roll 2' is inclined giving rise to a tendency of the sand to escape outward, so that the spring 33' is unable to exert pressure on the sand effectively. When kneading a reduced amount of sand, the weight of the roll 2' acts on the sand at all times, and especially while the sand is being discharged from the apparatus, the roll under gravity acts on a thin layer of sand with a pressure higher than is appropriate, producing hard plate-like pieces which seriously impair the quality of the molding sand.

Furthermore since the agitating rolls 2' have a flat outer peripheral surface, the sand is liable to escape from the surface outwardly of the roll. As a result, the agitating rolls 2' fail to exert pressure on the sand effectively and to achieve high kneading efficiency.

SUMMARY OF THE INVENTION

An object of this invention is to enable agitating rolls or act on a particulate to granular material (hereinafter referred to simply as "granular material") with a variable pressure most suitable to the quantity of the material to assure high kneading efficiency despite variations in the quantity of the material. Another object of the invention is to prevent escape of the granular material from the pressing peripheral surfaces of the agitating rolls to avoid a reduction in pressing efficiency. Another object of the invention is to reduce the pressure of the agitating rolls when kneading a small amount of granular material and to increase the pressure when kneading a large amount of granular material. Still another object of the invention is to provide agitating rolls having a recessed outer peripheral surface.

The present invention provides a kneader for granular materials comprising a container in the form of a bottomed hollow cylinder, a vertical shaft rotatably disposed in the center of the container, pivotal arms mounted on the vertical shaft and upwardly or downwardly turnable, an agitating roll rotatably supported by each of the pivotal arms and having a recessed outer peripheral pressing surface, and pressure adjusting means provided between each of the pivotal arms and the vertical shaft for controlling the pressure to be exerted by the agitating roll. When the agitating roll is raised by an increased amount of granular material in the container, the pressure adjusting means gives a downwardly acting pressure to the roll, permitting the roll to fully knead the increased amount of the material. When the pressure exerted on the material by the gravity acting on the agitating roll becomes excessive due to a reduction in the amount of the material, the pressure adjusting means gives the roll an upward force acting in the reverse direction to gravity, consequently reducing the pressure on the reduced amount of material, which can therefore be kneaded without entailing breaking of granules per se or formation of hard pieces. The recessed contour of the outer peripheral pressing surface of the agitating roll prevents the granular material from slipping off the surface, thus enabling the roll to achieve high pressing efficiency. Since the granular material can be subjected to the proper pressure in accordance with the quantity thereof, the power consumption involved is at an optimum level at all times with minimum power loss.

DESCRIPTION OF THE PREFERRED EMBODIMENTS

Figure 1:
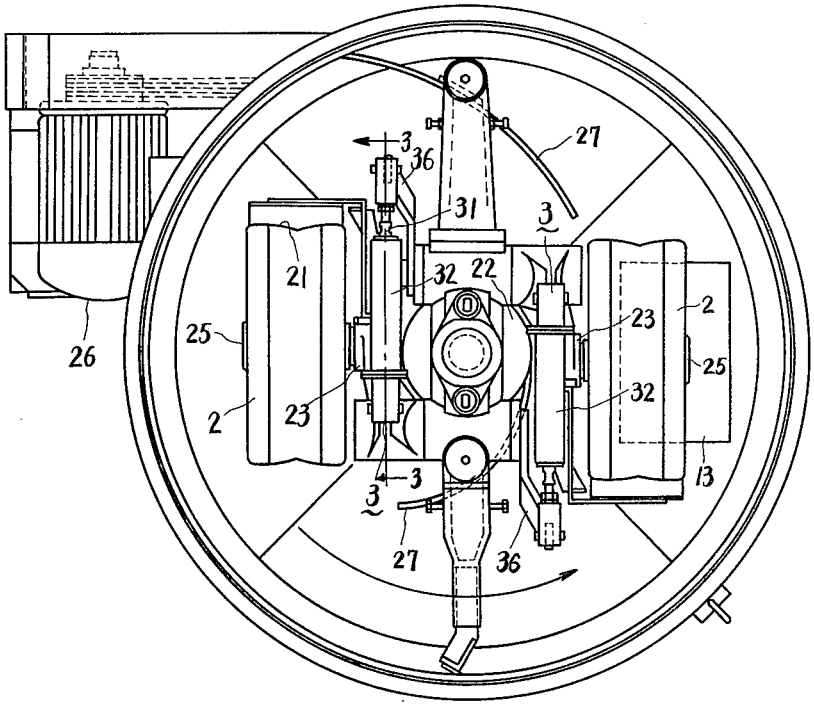
FIG. 1 is a plan view showing a kneader for granular materials according the invention.
Figure 2:
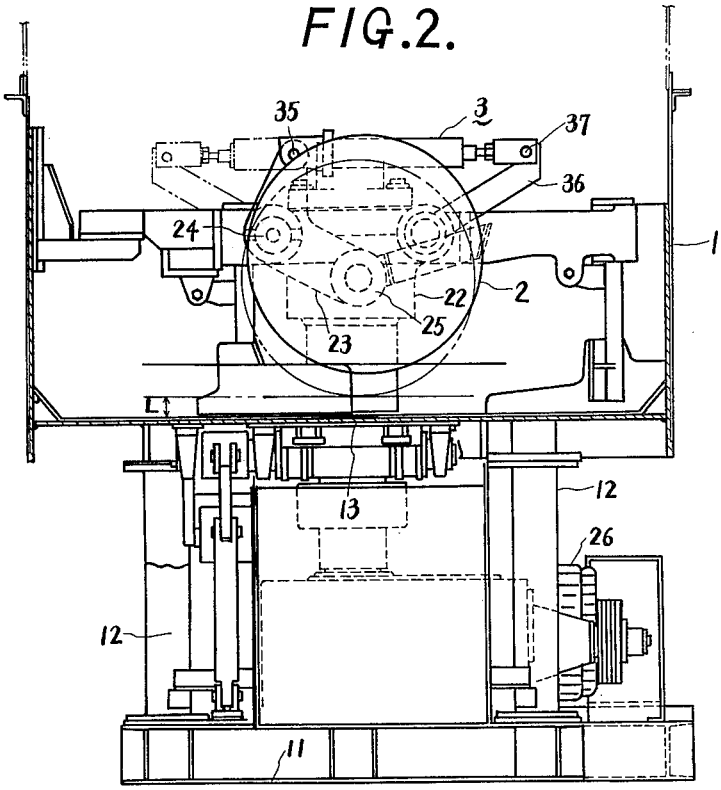
FIG. 2 is a side elevation in vertical section showing the same.

FIGS. 1 and 2 show an apparatus according to this invention for kneading granular materials. The kneader comprises a pair of agitating rolls 2 rotatably disposed within a container 1 in the form of a bottomed hollow cylinder for kneading granular materials, and pressure adjusting means 3 for each roll adapted to control the kneading pressure to be applied by the corresponding roll 2.

Each roll 2 has an outer peripheral pressing surface 21 with a circumferential V-shape recess therein and is in the form of a solid cylinder of specified width. The roll 2 is supported by a pivotal arm 23 on a vertical shaft 22 provided rotatably in the center of the container 1. The rolls 2 are coupled to a motor assembly 26 comprising a motor, power transmission mechanism, etc. The pivotal arm 23 is a substantially L-shaped plate, has its bent midportion pivoted to the vertical shaft by a pin 24 and is thereby turnable upward or downward. The agitating roll 2 is rotatably supported by a shaft 25 on one end of the arm 23. The rolls 2 are movable up and down vertically with respect to the bottom of the container 1 at all times.

Figure 3:
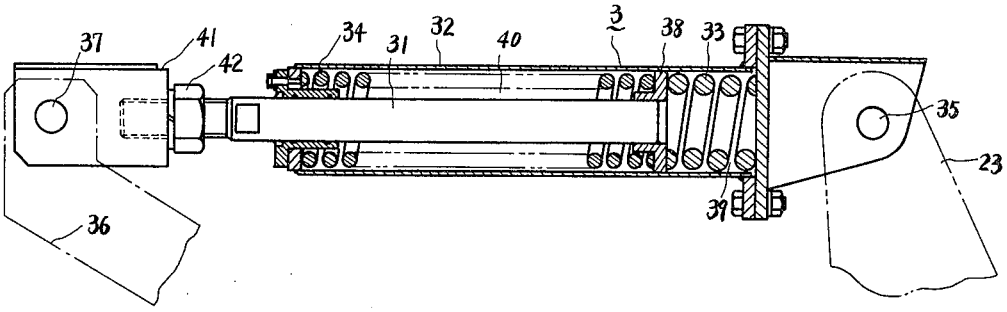
FIG. 3 is a partial sectional view, on an enlarged scale, taken on line 3—3 of FIG. 2.

As seen in FIG. 3, each of the pressure adjusting means 3 comprises a rod 31 connected at its base end to the vertical shaft 22 through pin 37 and arm 36, a cylinder 32 having the shaft 31 therein and a pair of springs 33 and 34 housed in the cylinder 32. The end of the cylinder 32 opposite to the end thereof through which the rod 31 is inserted in the cylinder 32 is pivotally connected to the other end of the pivotal arm 23 by a pin 35. The rod 31 is pivotally connected at its base end to the bar 36 projecting from the vertical shaft 22 by the pin 37. The rod 31 has a free inner end provided with a flange 38 having a diameter approximately equal to the inside diameter of the cylinder 32. The flange 38 divides the interior of the cylinder 32 into chambers 39 and 40 housing springs 33 and 34 respectively.

Indicated at 11 is a base supporting the container 1 on posts 12 and directly supporting the motor assembly 26, at 13 an outlet for discharging the granular material after kneading, and at 27 a scraper fixed to the shaft 22 close to a lower portion portion thereof. The scraper 27, when turned with the vertical shaft 22, moves the granular material toward the path of movement of the rolls 2 while stirring the material.

The kneader of the foregoing construction operates in the following manner.

When the motor assembly 26 is driven and a granular material, such as molding sand, contained in the container 1, the agitating rolls 2 revolve and the scrapers 27 turn with the rotation of the vertical shaft 22, whereby the material is kneaded.

Figure 4:
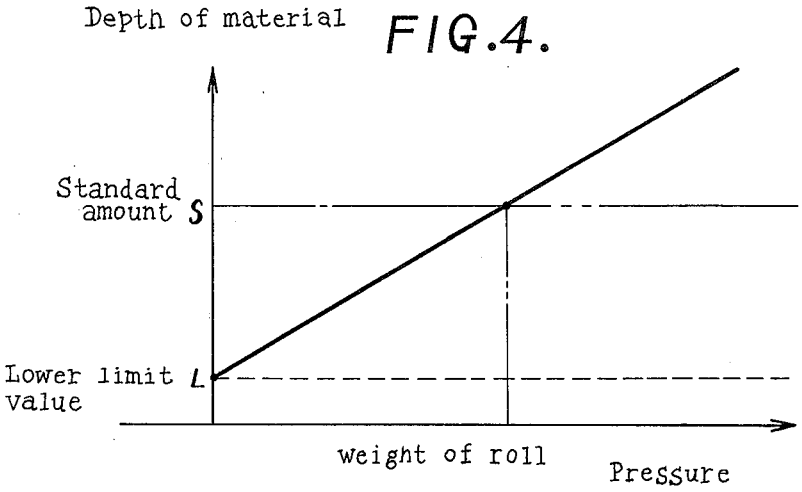
FIG. 4 is a diagram showing the relation between the depth of granular material and the pressure applied thereto in kneaders of this invention and the prior art.
Figure 5:
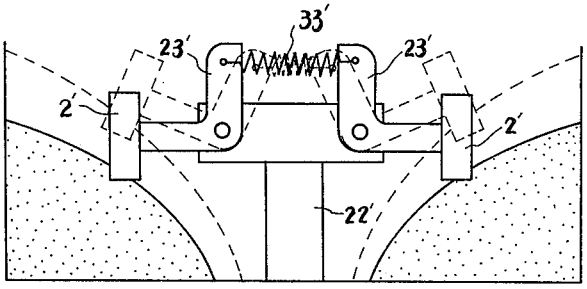
FIG. 5 is a view in vertical section schematically showing a conventional apparatus.

In this operation, the pressure to be applied by the agitating roll 2 is determined by the weight of the roll and the elastic force of the springs 33 and 34 which varies with the level at which the roll 2 is positioned, as seen in FIG. 4.

The agitating roll 2 is raised by the material placed in the container 1. When the amount of material is a standard amount S and the roll 2 raised to the standard position (indicated by the solid lines in FIG. 2) where the force of spring 33 is in balance with that of spring 34, the weight of the roll 2 alone acts on the material as the only pressure thereon.

When the agitating roll 2 is raised to a level above the standard position with an increase in the amount of the granular material, the rod 31 moves outward from the cylinder 32, compressing only the spring 34. Consequently the weight of the roll 2 and the force of the spring 34 are combined to act on the material as the pressure thereon.

When the agitating roll 2 is raised to a level lower than the standard position due to a small amount of granular material, the rod 31 is retracted inwardly of the cylinder 32, compressing only the spring 33. The resulting pressure is the weight of the agitating roll 2 minus the force of the spring 33.

Accordingly the material can be kneaded under the desired pressure condition at all times in accordance with the amount of the material.

The pressure of the roll 2 is reduced to zero when the weight of the roll 2 is in balance with the force of the spring 33. In this state, the roll 2 is in its lower limit position indicated by the broken lines in FIG. 2 and at a height L from the bottom of the container 1. The height L is easily variable by moving a nut 42 on an adjusting member 41 at the base end of the rod 31 and thereby altering the distance between the flange 38 and the pin 37.

Since the agitating roll 2 has the recessed peripheral pressing surface 21, the layer of granular material is retained under the pressing surface 21 for the application of pressure without allowing the pressed portion of the material to slip off the surface 21. Additionally the recessed contour of the surface 21 serves to compensate for the wear of the outer portion of the roll. While the layer of granular material pressed includes a portion close to the bottom of the container 1 and another portion close to the recessed pressing surface 21, these two portions will slide in directions opposite to each other. Thus the material will be subjected to an improved shearing action and enhanced pressing action for efficient kneading.

The recessed pressing surface 21 is not limited to a V-shaped cross section. It has been found that a trapezoidal or arcuate cross section produces substantially comparable effects.

Although molding sand is exemplified above as a granular material, the material to be kneaded by the present apparatus is not limited to molding sand.

Figure 3A:
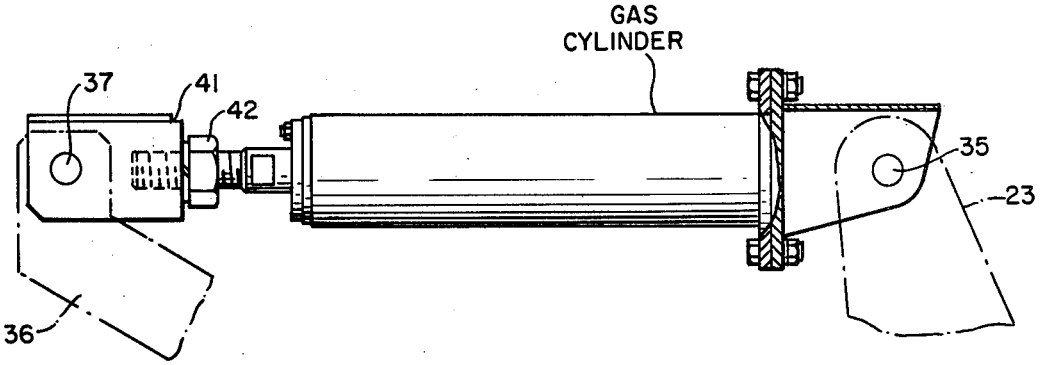
FIG. 3*a* is a view similar to FIG. 3 of a modified form of the device of FIG. 3.
Figure 3B:
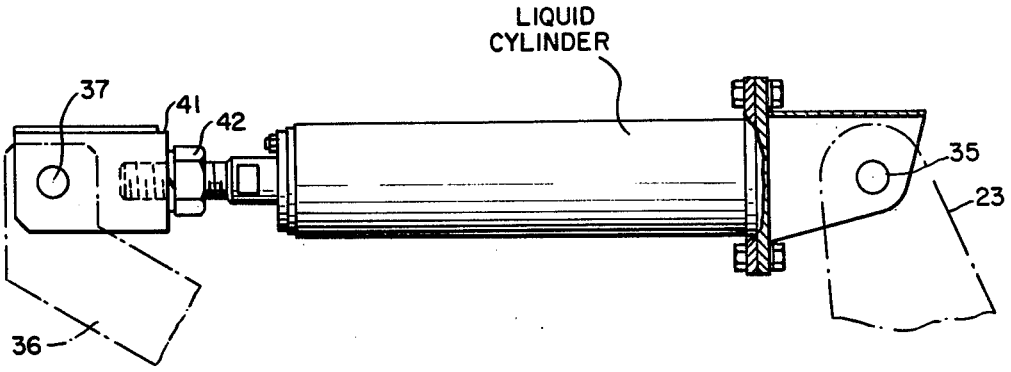
FIG. 3*b* is a view similar to FIG. 3 of a modified form of the device of FIG. 3.

Any desired number of agitating rolls 2 are usuable in place of the pair of rolls 2, while the number of the scrapers 27 is of course variable. The means for biasing the rod 31 is not limited to the springs 33 and 34; the flange 38 and the cylinder 32 may be arranged gas- or liquid-tightly to enclose a gas, as shown in FIG. 3*a*, or liquid in the cylinder, as shown in FIG. 3*b*, for use as the biasing means.

As described above, the kneader of this invention is adapted to give an optimum pressure to the granular material to be kneaded in accordance with the amount of the material, and the recessed pressing surface serves to apply the pressure with improved effectiveness. Thus the kneader has the outstanding advantage of achieving increased kneading efficiency.

Especially when the material is discharged from the apparatus after kneading, the pressure decreases with the decrease in the amount of material without subjecting the material to excessive pressure to prevent blocking of the material. The pressure adjusting means also serves to make the agitating roll movable upward or downward without subjecting it to a shock.

What we claim is:

1. A kneader for particulate or granular materials comprising:

a container having the shape of a bottomed hollow cylinder;

a vertical shaft rotatably mounted in the center of the interior of the container;

roll carrier means having agitating rolls rotatably mounted thereon, said roll carrier means being pivotally mounted on the vertical shaft for causing said rolls to move upwardly or downwardly by pivotal movement of said roll carrier means; and pressure adjusting means connected to said roll carrier means for varying the pressure applied to the agitating rolls in accordance with the level at which the rolls are positioned, said pressure adjusting means having a cylinder member, a rod slidably extending into the cylinder member and having a flange at the end within the cylinder for dividing the interior of the cylinder member into two chambers, and means disposed in the respective chambers for biasing the rod in opposite directions when said flange is moved from a neutral position in said cylinder member, one of the cylinder member and the rod being connected at one end portion thereof to the vertical shaft, the other of the cylinder member and the rod being connected at the other end portion thereof to said roll carrier means.

2. A kneader as claimed in claim 1 in which said roll carrier means comprises a plurality of arms pivoted to said vertical shaft, said arms each having a single roll rotatably mounted thereon, and there is a pressure adjusting means connected to each arm.

3. A kneader as defined in claim 1 wherein each of the rod biasing means is a spring.

4. A kneader as defined in claim 1 wherein each of the rod biasing means is a gas enclosed in the respective chambers, said flange separating said chambers in sliding gas tight relation with said cylinder.

5. A kneader as claimed in claim 1 wherein each of the rod biasing means is a liquid enclosed in the respective chambers, said flange separating said chambers in sliding liquid tight relation.

6. A kneader for particulate or granular materials comprising:

a container having the shape of a bottomed hollow cylinder;

a vertical shaft rotatably mounted in the center of the interior of the container;

roll carrier means having agitating rolls rotatably mounted thereon, said roll carrier means being pivotally mounted on the vertical shaft for causing said rolls to move upwardly and downwardly by pivotal movement of said roll carrier means; and pressure adjusting means connected to said roll carrier means for varying the pressure applied to the agitating rolls in accordance with the level at which the rolls are positioned, each of the agitating rolls having a recess in the peripheral surface thereof extending circumferentially thereof for inhibiting the material being kneaded from slipping out from under the rolls.

* * * * *